US005514438A

United States Patent [19]

Crook, Jr.

[11] Patent Number: 5,514,438

[45] Date of Patent: May 7, 1996

[54] PAPERMAKERS FABRIC

[75] Inventor: Robert L. Crook, Jr., Wilson, N.C.

[73] Assignee: Scapa Group PLC, Lancashire, United Kingdom

[21] Appl. No.: 328,624

[22] Filed: Oct. 25, 1994

[30] Foreign Application Priority Data

Oct. 26, 1993 [GB] United Kingdom ..... 9321992

[51] Int. Cl.[6] ..... D21F 7/10

[52] U.S. Cl. ..... 428/57; 24/33 P; 24/33 C; 24/391; 139/383 A; 139/383 AA; 428/58; 428/192; 428/373; 428/377; 428/378

[58] Field of Search ..... 428/57, 58, 192, 428/373, 377, 378; 139/393 A, 383 AA; 24/33 P, 391, 33 C; 162/DIG. 1

[56] References Cited

U.S. PATENT DOCUMENTS 4,469,142 9/1984 Harwood ..... 139/383 A
5,031,283 7/1991 Aldrich ..... 24/33 P

*Primary Examiner*—Nasser Ahmad
*Attorney, Agent, or Firm*—Keck, Mahin & Cate

[57] ABSTRACT

A papermakers fabric comprises a felt made up of a base cloth and a batt of fibres needled to the base cloth. The papermakers fabric is woven from machine direction yarns and cross machine direction yarns. The machine direction yarns form a series of loops at each of the fabric ends, the two sets of loops being interdigitable and capable of union by a pintle wire. The machine direction yarns comprise a core of cabled monofilaments surrounded by a sheath of multifilaments.

10 Claims, 1 Drawing Sheet

PAPERMAKERS FABRIC

The present invention relates to a papermakers fabric and more particularly to a base cloth for a papermakers felt.

BACKGROUND OF THE INVENTION

It is known to produce a seamed base cloth for a papermakers felt made up of cabled monofilament yarns. The cabled yarns impart limited elasticity to the felt which is necessary for very long papermakers felts, that is felts in the order of 50 m to 70 m long. However, there are tremendous difficulties in seaming such felts. When the cabled yarns are turned back into a loop invariably one of the cabled yarns becomes untwisted and blocks the channel formed by the interdigitated loops provided at the two ends of the base cloth. Thus the hinge wire cannot freely pass down the long channel.

The present invention has been made from a consideration of this problem.

SUMMARY OF THE INVENTION

According to the present invention there is provided a papermakers fabric comprising a base cloth for a papermakers felt for forming a belt on a papermaking machine, the base cloth being woven from a plurality of first yarns extending in the intended running direction of the belt and second yarns extending in the intended cross machine direction of the belt, wherein at least some of the first yarns form a series of loops at the base cloth, the loops of the respective base cloth ends being interdigitated to form, with a hinge wire, a seam, wherein the loop forming first yarns comprise a core of cabled monofilaments surrounded by a sheath of multifilaments.

The papermakers felt can be made by needling a batt of fibres into the base cloth in the conventional manner.

The multifilament sheath binds the cabled monofilaments together. Thus the sheath acts to pull in any rogue filaments which would otherwise impede the passage of the hinge wire. The sheath also acts to protect the core filaments from wear and abrasion while surprisingly not adversely affecting the extensibility of the fabric.

The base cloth of the present invention has excellent extensibility and long term stability.

The core and sheath of the running direction yarns may be made from any suitable materials. Polymeric materials are preferred such as:—polyamide, polyester or polyalkenes. Preferred examples include Kevlar (RTM) or gel-spun polyethylene owing to their superior strength and abrasion resistance.

In a preferred embodiment of the invention the sheath is treated with resin in order to convert the multi-filament bundle, in effect, into a larger quasi-monofilament. The resin treatment makes passage of the hinge wire through the channel even more easier. The sheath readily accepts the resin treatment- This can be effected by any suitable method such as dip coating. Suitable resins include any of the following either alone or in combination:—melamine, polyurethane, epoxies, phenolics or resorcinol-formaldehyde.

In a preferred embodiment of the invention the area of fabric immediately adjacent the seam loops is coated with a wear resistant polymer so as to protect the loops from wear and abrasion on the machine. Suitable polymers include any of the following either alone or in combination:—polyurethane, epoxies or silicones.

The base cloth of the present invention i.e. particularly useful in producing limited caliper fabrics, that is a Caliper below 1.30 mm.

The cross machine direction yarns may comprise any type of yarns. Monofilament yarns are preferred. These may be made from any suitable material. Synthetic polymers are preferred such as polyamide, polyester or polyethylene.

BRIEF DESCRIPTION OF THE DRAWINGS

In order that the present invention may be more readily understood a specific embodiment thereof will now be described by way of example only with reference to the accompanying drawings in which.

DETAILED DESCRIPTION OF THE PREFERRED EMBODIMENT

Figure 1:
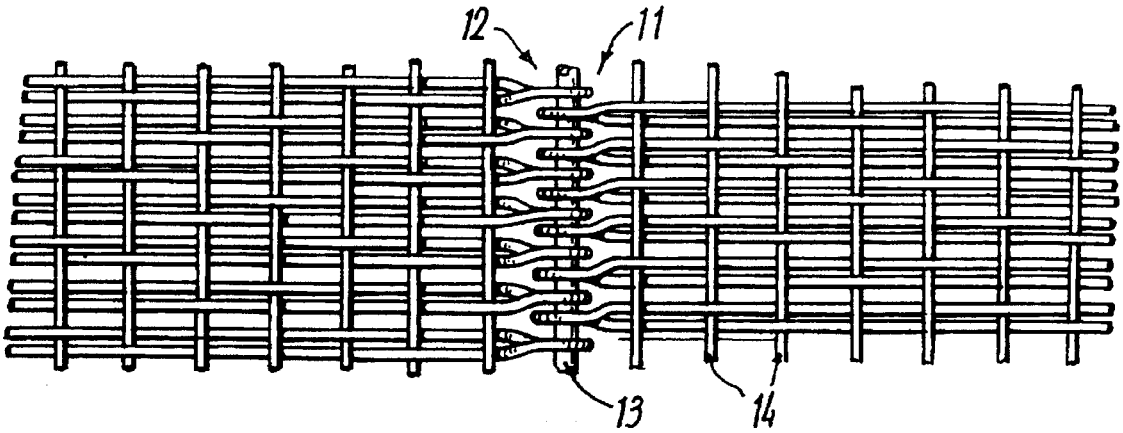
FIG. 1 is a plan view of one seamed base fabric in accordance with the present invention.
Figure 2:
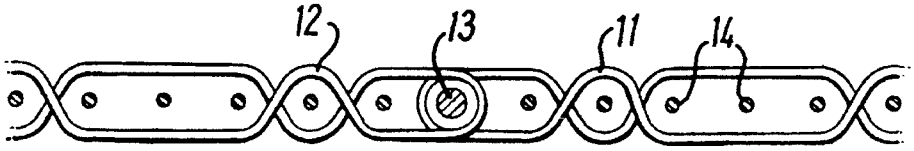
FIG. 2 is a side elevation of the fabric of FIG. 1.
Figure 3:
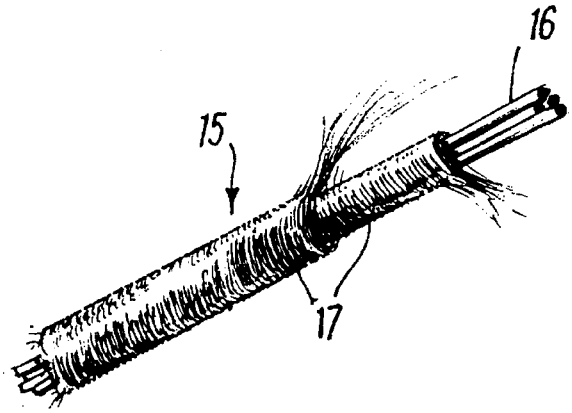
FIG. 3 is a cross section through one of the loop forming yarns of the fabric of FIGS. 1 and 2.

Referring to FIGS. 1 and 2 two ends 11,12 of a woven base cloth for a papermakers felt are united at their edges by a hinge wire 13 so as to form an endless belt. The weave pattern of the base cloth is shown in detail in FIG. 2. The base cloth comprises polyamide monofilament yarns 14 in the cross machine direction. One sheathed yarn 15 is shown in more detail in FIG. 3. The yarn consists of single monofilaments 16 and continuous multifilaments 17 twisted together so as to give a sheath-core effect, that is a fibrous multifilament sheath and a cabled monofilament core. The core filament may comprise any twisted or cabled monofilament such as 0.008" (0.2mm) mono/2 ply/2 fold cable; 3 ply 0.010 (0.2 mm); or 0.008" (0.2 mm)/2 ply/3 fold cable. The sheath yarn is preferably an untwisted continuous multifilament with good abrasion resistance such as polyamide or polyethylene. Twist liveliness in the sheath may be eliminated by providing an inner sheath with a "Z" twist direction and an outer sheath with a "S" twist direction.

At the ends 11,12 of the base cloth the running direction yarns are formed into loops and are then fed back into the fabric and woven together with the cross machine weft threads.

The running direction yarns are preferably resin treated either prior to being woven into the cloth or less preferably in situ.

A line of wear resistant polymer is applied immediately adjacent each side of the yarn loops in order to protect the loops from wear.

A fibrous layer is subsequently needled to the base cloth so as to provide a felt suitable for making board.

The felt overcomes the shortcomings of known seam felts in performing on paper machines when tensile extensibility, limited caliper and seam loop wear resistance are required, for example in multi-cylinder making positions.

It is to be understood that the embodiment described above has been described above has been made by way of example only. Many modifications and variations are possible.

I claim:

1. A papermakers fabric comprising a base cloth for a papermakers felt for forming a belt for a papermaking machine having a running direction and a cross machine direction, the base cloth having opposite ends and being woven from a plurality of first yarns extending in an intended running direction of the belt and second yarns extending in an intended cross machine direction of the belt, wherein at least some of the first yarns form a series of loops unitary with and at each of the base cloth ends, the loops of the respective base cloth ends being interdigitated to form, with a hinge wire located perpendicular to the first yarn, a seam, wherein the first yarns which form the loops comprise a core of cabled monofilaments surrounded by a sheath of multifilaments.

2. A papermakers fabric as claimed in claim 1, wherein the fabric comprises a felt made up from the said base cloth in combination with a part of fibres.

3. A papermakers fabric as claimed in claim 1, wherein the first yarns comprise a member selected from the group consisting of polyamide, polyester and polyalkene.

4. A papermakers fabric as claimed in claim 1, wherein the sheath is treated with resin.

5. A papermakers fabric as claimed in claim 4, wherein the resin comprises at least one member selected from the group consisting of melamine, polyurethane, epoxies, phenolics and resorcinol-formaldehyde.

6. A papermakers fabric as claimed in claim 1, wherein the area of the fabric immediately adjacent the loops which form the seam is polymer coated.

7. A papermakers fabric as claimed in claim 6, wherein the polymer coating comprises at least one member selected from the group consisting of polyurethane, epoxies and silicones.

8. A papermakers fabric as claimed in claim 1, wherein the second yarns comprise monofilament yarns.

9. A papermakers fabric as claimed in claim 1, wherein the second yarns comprise a member selected from the group consisting of polyamide, polyester and polyethylene.

10. A papermakers fabric as claimed in claim 1, having a caliper that is below 1.30 mm.

* * * * *